US011623715B1

(12) United States Patent
Lindner et al.

(10) Patent No.: US 11,623,715 B1
(45) Date of Patent: Apr. 11, 2023

(54) MOTION DAMPER FOR FLOATING STRUCTURES

(71) Applicant: United States of America as represented by the Administrator of NASA, Washington, DC (US)

(72) Inventors: Jeffrey L. Lindner, Huntsville, AL (US); Robert E. Berry, Madison, AL (US); Frederick Scott Gant, Huntsville, AL (US); John S. Townsend, Union Grove, AL (US); Rebecca L. Williams, Huntsville, AL (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 0 days.

(21) Appl. No.: 17/935,806

(22) Filed: Sep. 27, 2022

(51) Int. Cl.
*B63B 39/02* (2006.01)

(52) U.S. Cl.
CPC ..... *B63B 39/02* (2013.01)

(58) Field of Classification Search
CPC ..... B63B 39/00; B63B 39/02
USPC ..... 114/121, 122, 124, 125
See application file for complete search history.

(56) References Cited

U.S. PATENT DOCUMENTS 4,176,614 A * 12/1979 Goss ..... B63B 39/03 405/200
4,864,858 A * 9/1989 Namiki ..... G01M 1/28 73/457
6,910,438 B2 6/2005 Leverette et al.
8,215,253 B2 * 7/2012 Kim ..... F16F 7/10 114/264

FOREIGN PATENT DOCUMENTS

WO WO 2020/093037 A2 5/2020

* cited by examiner

*Primary Examiner* — Daniel V Venne
(74) *Attorney, Agent, or Firm* — Jerry L. Seemann; Trenton J. Roche

(57) ABSTRACT

A motion damper for structures includes a housing coupled to a structure such that the housing moves in correspondence with the structure. The housing includes a wall with a vent, and has an air chamber therein in fluid communication with the vent. A piston is sealed within the housing for one-dimensional motion therein. A rigid plate is disposed within the housing's air chamber. The plate is disposed between the piston and the vent, and is spaced apart from and fixedly coupled to the piston such that the plate moves in correspondence with the one-dimensional motion of the piston. At least one spring is mounted in the housing and is coupled to the plate for applying a force thereto that is in opposition to the one-dimensional motion of the piston.

23 Claims, 5 Drawing Sheets

MOTION DAMPER FOR FLOATING STRUCTURES

ORIGIN OF THE INVENTION

The invention described herein was made in the performance of work under a NASA contract and by an employee of the United States Government and is subject to the provisions of Public Law 96-517 (35 U.S.C. § 202) and may be manufactured and used by or for the Government for governmental purposes without the payment of any royalties thereon or therefore. In accordance with 35 U.S.C. § 202, the contractor elected to retain title.

BACKGROUND OF THE INVENTION

Field of the Invention

This invention relates to motion dampers. More specifically, the invention is a motion damper for use on structures such as those that float on a body of water.

Description of the Related Art

A variety of static and moving structures are subject to unwanted motion caused by environmental conditions. For example, maritime structures floating at the surface of a body of water (e.g., ships, barges, floating wind turbines, etc.), are subject to wave excitation that can cause a structure to experience pitch, roll, and/or heave motions that can limit the performance of the structure. In addition, wave-induced motion of maritime structures often reduces the lifespan thereof owing to structural degradation brought on by unmitigated wave-induced motion.

Performance and structural degradation of maritime structures are greatly exacerbated in the face of high-amplitude wave excitation. There are multiple families of existing tuned mass dampers and tuned vibration absorbers that are used for a variety of motion-damping applications across multiple industries. However, conventional motion dampers are not capable of damping the range of motion amplitudes and motion frequencies experienced by maritime structures in open water environments.

SUMMARY OF THE INVENTION

Accordingly, it is an object of the present invention to provide a motion damper for structures.

Another object of the present invention to provide a motion damper for maritime structures.

Yet another object of the present invention is to provide a motion damper for installation on structures floating on the surface of a body of water.

Still another object of the present invention is to provide a motion damper configurable for the damping of motion of maritime structures subject to high-amplitude excitation forces.

Other objects and advantages of the present invention will become more obvious hereinafter in the specification and drawings.

In accordance with the present invention, a motion damper for structures includes a housing adapted to be coupled to a structure such that the housing moves in correspondence with the structure. The housing includes a wall with a vent. The housing has an air chamber therein in fluid communication with the vent. A piston is sealed within the housing for one-dimensional motion therein. A rigid plate is disposed within the housing's air chamber. The rigid plate is disposed between the piston and the vent. The rigid plate is spaced apart from and fixedly coupled to the piston such that the rigid plate moves in correspondence with the one-dimensional motion of the piston. At least one spring is mounted in the housing and is coupled to the rigid plate for applying a force to the rigid plate that is in opposition to the one-dimensional motion of the piston.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

Figure 7:
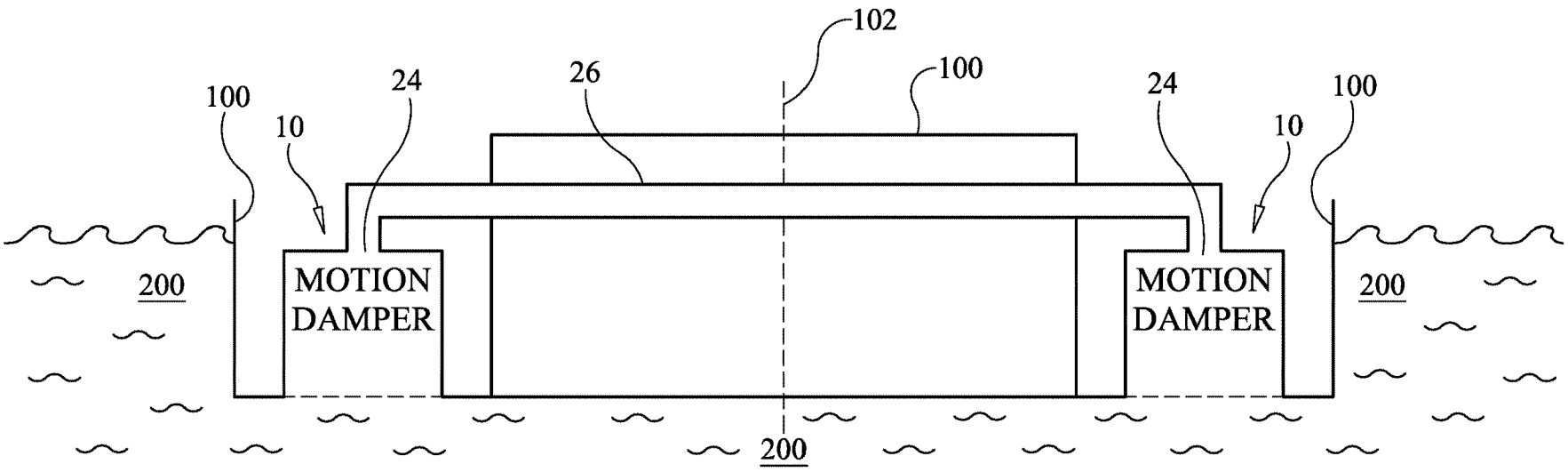
Figure 8:
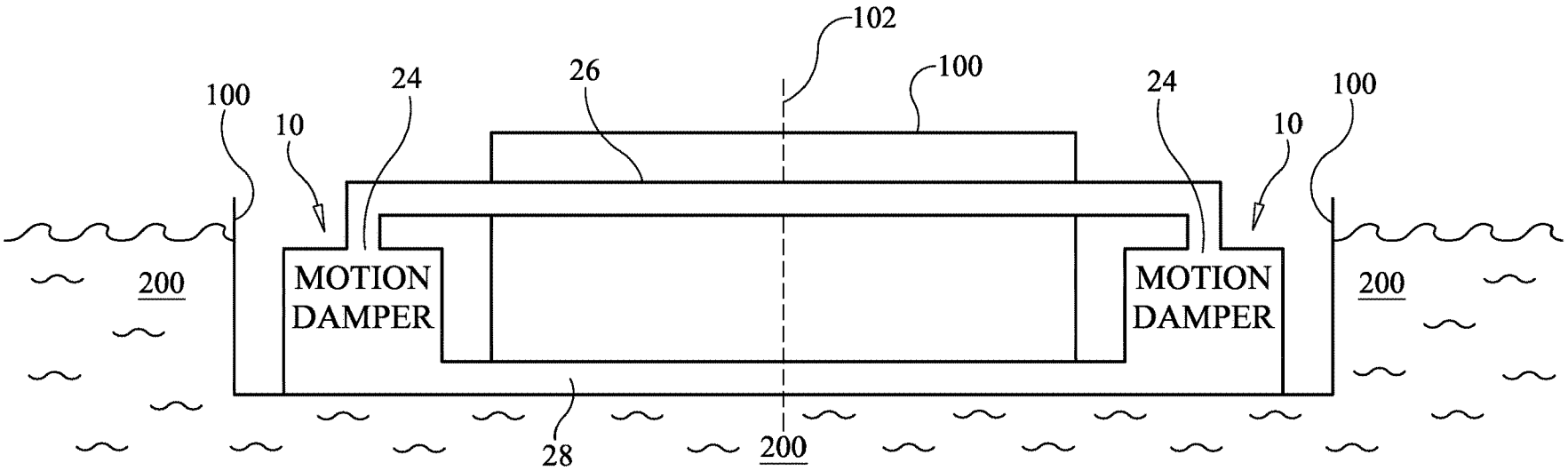

FIG. 7 is a schematic view of a floating structure having two motion dampers of the present invention installed thereon with their vents in fluid communication in accordance with another embodiment of the present invention; and FIG. 8 is a schematic view of a floating structure having two motion dampers of the present invention installed thereon with their respective vents and pistons in fluid communication in accordance with another embodiment of the present invention.

DESCRIPTION OF THE PREFERRED EMBODIMENT(S)

Figure 1:
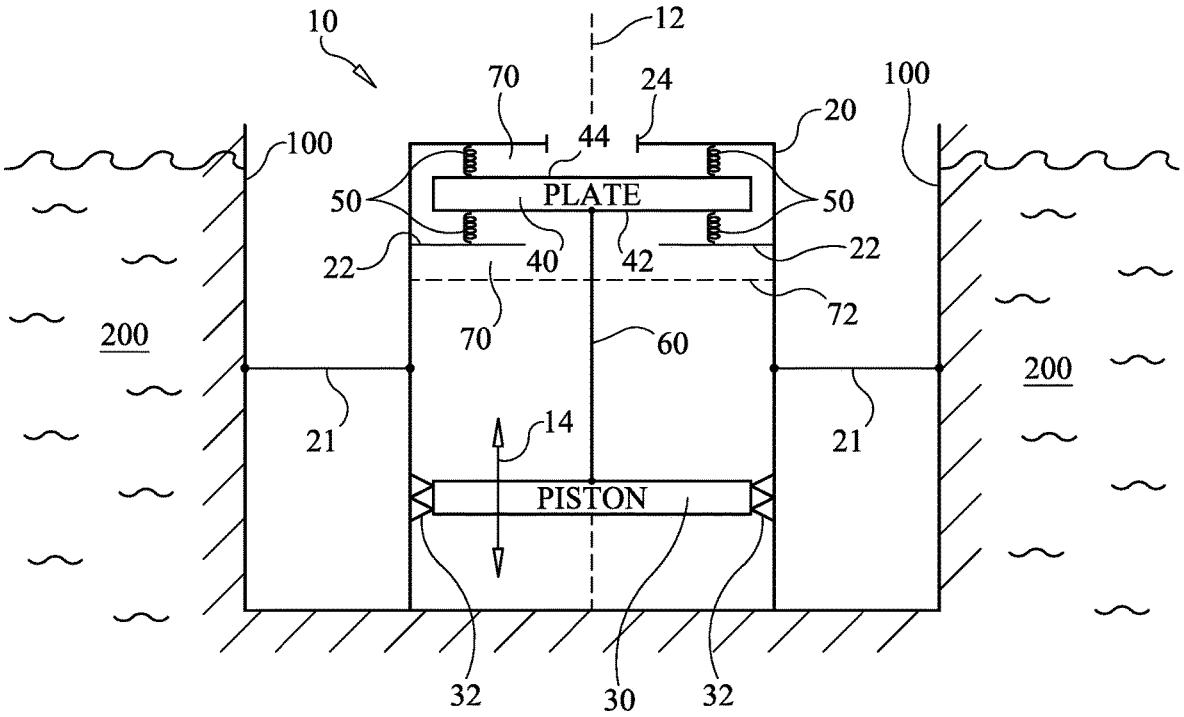
FIG. 1 is a schematic view of a motion damper for a floating structure in accordance with an embodiment of the present invention.

Referring now to the drawings and more particularly to FIG. 1, a schematic view of a motion damper for a structure 100 in accordance with an embodiment of the present invention is shown and is referenced generally by numeral 10. While the present invention can be adapted for use with land-based and water-based structures, the description to follow will assume that structure 100 is a floating structure. Floating structure 100 can be any fixed or movable "platform" configured for floating at the surface of a body of water 200, e.g., a river, lake, bay, ocean, etc. Examples of floating structure 100 include, but are not limited to, ships, barges, and wind turbine platforms. In general, most such floating structures include ballast tanks (not shown) to control the structure's buoyancy as is well understood in the art.

As is well-known in the art, wave and wind action occurring at the surface of water 200 causes floating structure 100 to experience one or more of roll, pitch, and heave motions. The amplitude and/or frequency of the structure's motions can negatively impact the performance and integrity of the structure. As will be explained further below, motion damper 10 presents a novel approach to damping out a wide range of the wave and wind induced motions of floating structure 100. While the essential features of a single motion damper 10 will be described herein, it is to be understood that many applications could benefit from the installation of a plurality of motion damper 10 on a floating structure. Accordingly, some representative examples of multiple motion damper installations will also be described herein.

Motion damper 10 includes a rigid housing 20 that is fixedly coupled to some designated portion of floating structure 100 by coupling elements 21 such that housing 20 experiences the motion of floating structure 100 at the designated portion of the floating structure. The placement, orientation, and method of fixing housing 20 to floating structure 100 (using coupling elements 21) are chosen to address the specific motion damping needs of a particular application and are, therefore, not limitations of the present invention. Coupling elements 21 can be realized by, for example, rigid brackets, beams, and/or other conventional coupling elements for fixedly coupling housing 20 to floating structure 100 in ways well-understood by one of ordinary. skill in the art such that housing 20 moves in correspondence with floating structure 100. However, in general, motion damper 10 has an axis of damping sensitivity (indicated by dashed line 12) aligned with the longitudinal axis of housing 20. In the illustrated example, motion damper 10 is coupled to floating structure 100 via coupling elements 21 such that its axis of damping sensitivity 12 is approximately perpendicular to the surface of water 200 thereby making motion damper 10 sensitive to heave motion of floating structure 100.

Disposed within housing 20 are a piston 30, a rigid plate 40 coupled to piston 30, and one or more springs 50 coupled to plate 40 and housing 20. Piston 30 is sealed within housing 20 in a way that allows piston 30 to experience one-dimensional motion along axis of damping sensitivity 12. For example, an annular rolling diaphragm 32 can be positioned between the periphery of piston 30 and the inside surface of housing 20 to support the one-dimensional movement (e.g., up or down in the illustration) of piston 30 within housing 20 as well as provide a fluid seal between housing 20 and piston 30. Since the functions of piston 30 and rolling diaphragm 32 could also be achieved with other structures (e.g., bellows or diaphragm sealed within housing 20), the term "piston" as used herein can be extended to include such alternative structures without departing from the scope of the present invention.

Plate 40 is rigidly coupled to and spaced apart from piston 30 along axis of damping sensitivity 12 such that plate 40 moves in unison with piston 30 along axis of damping sensitivity 12. Coupling of piston 30 to plate 40 can be achieved by a rigid support (or supports) 60, the design of which is (are) not a limitation of the present invention. In all embodiments of the present invention, plate 40 resides and moves within a gaseous/air space or chamber 70 within housing 20. In the illustration, the delineation between air chamber 70 and the rest of housing 20 is indicated by a dashed line 72. The line of delineation 72 can be created in a variety of ways without departing from the scope of the present invention. Several non-limiting embodiments of the present invention will be presented later below to illustrate exemplary ways to create air chamber 70.

One or more springs 50 are disposed in housing 20 and are coupled to plate 40 such that springs 50 apply forces to plate 40 that are in opposition to both directions of the one-dimensional movement of plate 40 along axis of damping sensitivity 12. For example and as illustrated, springs 50 are coupled to the opposing faces 42/44 of plate 40, and to rigid portions of housing 20 (e.g., a wall of housing 20, rigid supports 22 within housing 20, etc.). Springs 50 can be realized by a variety of constructions without departing from the scope of the present invention.

Figure 2:
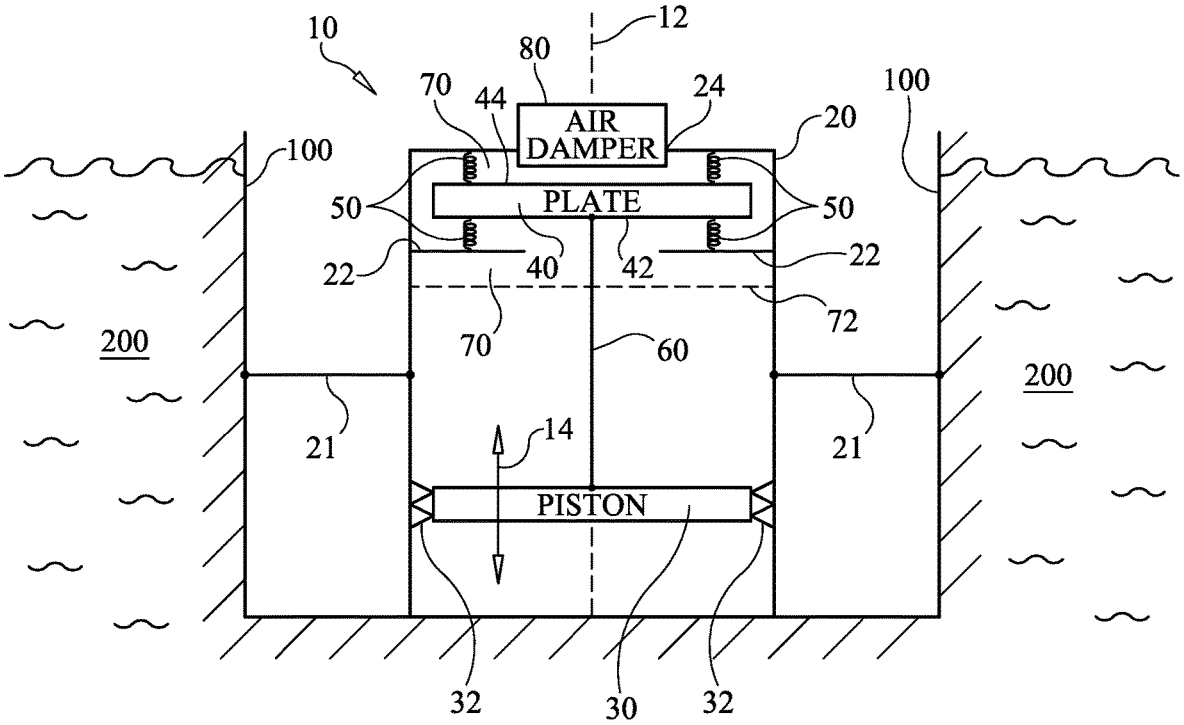
FIG. 2 is a schematic view of a motion damper for a floating structure incorporating an air damping device in accordance with another embodiment of the present invention.

Housing 20 is also provided with at least one vent 24 that provides fluid communication between air chamber 70 and a gaseous or air environment external to housing 20. As will be explained further below, the external gaseous environment can be ambient air or an enclosed air space in a manifold coupled to vent 24 depending on the installation configuration. In some embodiments of the present invention, the size of vent 24 controls the amount of air/gas flow there through. In other embodiments of the present invention and as illustrated in FIG. 2, an air damping device 80 can be provided in vent 24. Such air damping devices can include, for example, a simple orifice plate, a tuned port, an adjustable valve, a reed valve, a variable-aperture reed (VARR) valve, or any other air/gas flow control element(s). Air damping device 80 can be placed directly in vent 24 (as shown) or can be placed in a conduit (not shown) coupled and sealed to vent 24 without departing from the scope of the present invention.

In each embodiment of the present invention, motion damper 10 damps motion of floating structure 100 by capturing a mass of a liquid contained inside of housing 20. The mass of the captured liquid acts on piston 30 in accordance with the motion of floating structure 100 at the installation location of motion damper 10. Any component of the floating structure's motion that is aligned with axis of damping sensitivity 12 is then damped. More specifically, as piston 30 is moved along axis of damping sensitivity 12 along either direction as indicated by two-headed arrow 14 when the forces of springs 50 are exceeded, air flows through the restriction defined by vent 24 (or air damping device 80 in fluid communication with vent 24). The force provided by springs 50 and the air flow restriction provided at vent 24 can be tailored to tune motion damper 10 in terms of its amplitude, frequency, and phase response. In general, movement of piston 30 is effected by a fluid acting thereon as will be explained further below in descriptions of various embodiments of the present invention.

Motion damper 10 can be constructed in an on-shore environment and then transported to its in-the-water installation. Accordingly, motion damper 10 is ideally-suited as a retro-fit motion damper for existing floating structures. For new floating structures, motion damper 10 can be incorporated into an initial design and build. Regardless of its ultimate installation, motion damper 10 can leverage readily-available liquid (i.e., the surrounding body of water) in its motion damping operation. By way of illustrative examples, three designs of the present invention utilizing available water from the surrounding body of water will be described with reference to FIGS. 3-5.

Figure 3:
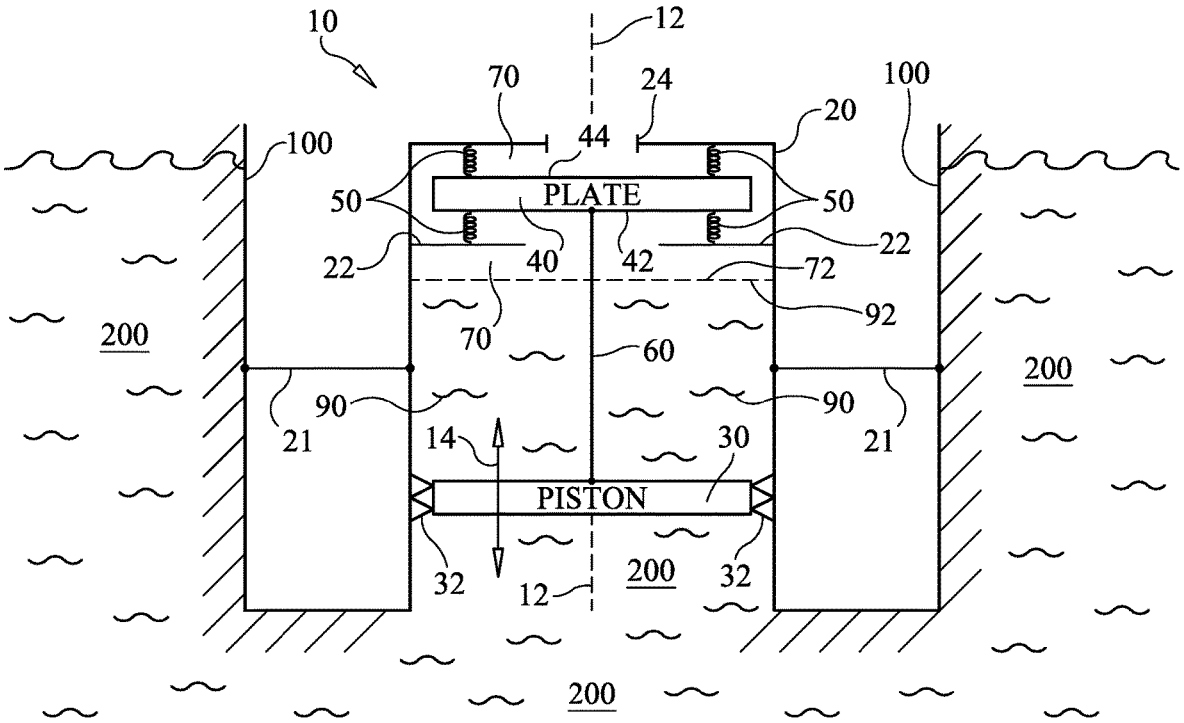
FIG. 3 is a schematic view of a motion damper partially filled with a liquid between the motion damper's piston and air chamber plate in accordance with an embodiment of the present invention.

The motion damper embodiment illustrated in FIG. 3 captures a mass of a liquid 90 in housing 20 with liquid 90 being in contact with the face of piston 30 that faces plate 40. The amount of liquid 90 is selected such that a free surface 92 of liquid 90 abuts air chamber 70 such that plate 40 remains in air chamber 70 for all expected movements of piston 30. That is, free surface 92 is commensurate with the above-described line of delineation 72 which will move in correspondence with the movement of piston 30. The face of piston 30 facing away from plate 40 is exposed to the external body of water 200. When water 200 moves to apply pressure to piston 30 or moves to pull away from piston 30, piston 30 moves to act on fluid mass 90 which opposes motion of structure 100. As the structure 100 moves (i.e., heaves, rolls, pitches) in water 200, the pressure exerted by water 200 on piston 30 changes, causing the piston to move in response to the structure's motion. This movement of the piston is damped via plate 40, springs 50, and vent 24 (or air damping device 80) which set the appropriate phase lag between piston 30 and structure 100, thus damping out the motion of structure 100.

Figure 4:
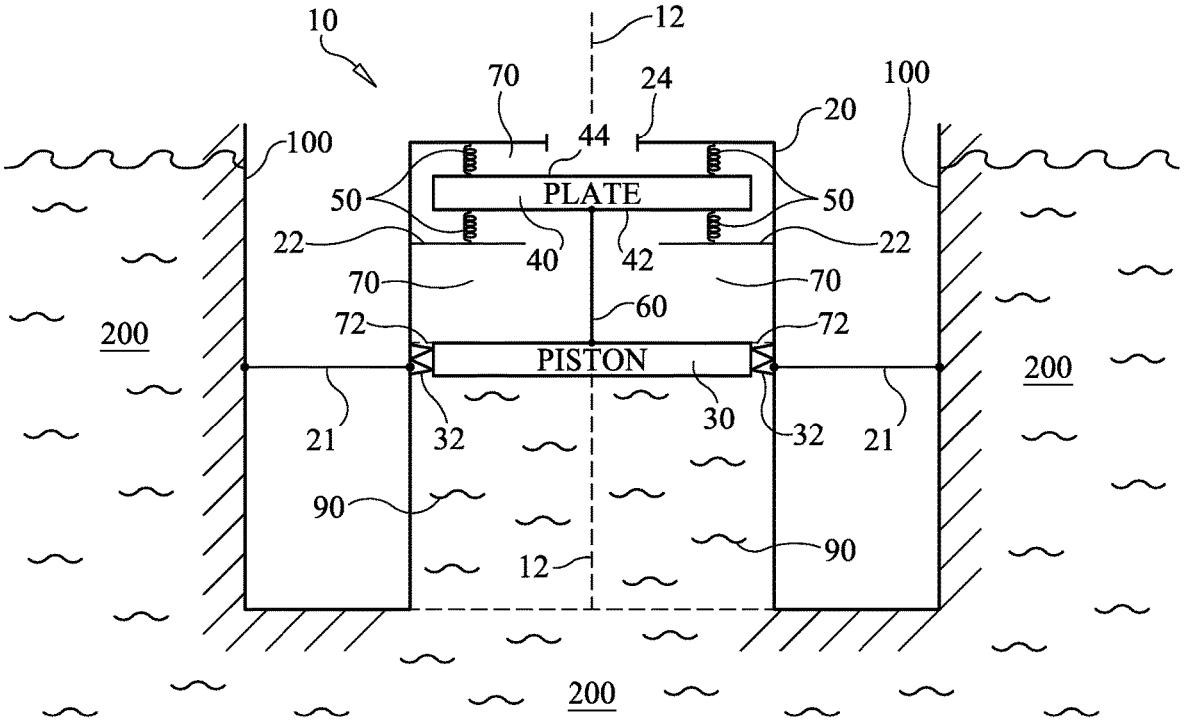
FIG. 4 is a schematic view of a motion damper partially filled with a liquid beneath the motion damper's piston in accordance with another embodiment of the present invention.

The motion damper embodiment illustrated in FIG. 4 also captures a mass of liquid 90 in housing 20 in a way that liquid 90 is separated from air chamber 70 by piston 30. That is, liquid 90 is in contact with the face of piston 30 that faces away from plate 40 whereas the face of piston 30 facing plate 40 is commensurate with the above-described line of delineation 72 of air chamber 70. As in the previous embodiment, the face of piston 30 facing away from plate 40 is exposed to the external body of water 200. When water 200 moves to apply pressure to piston 30 or moves to pull away from piston 30, motion of structure 100 is damped in the same way as described above for FIG. 3

Figure 5:
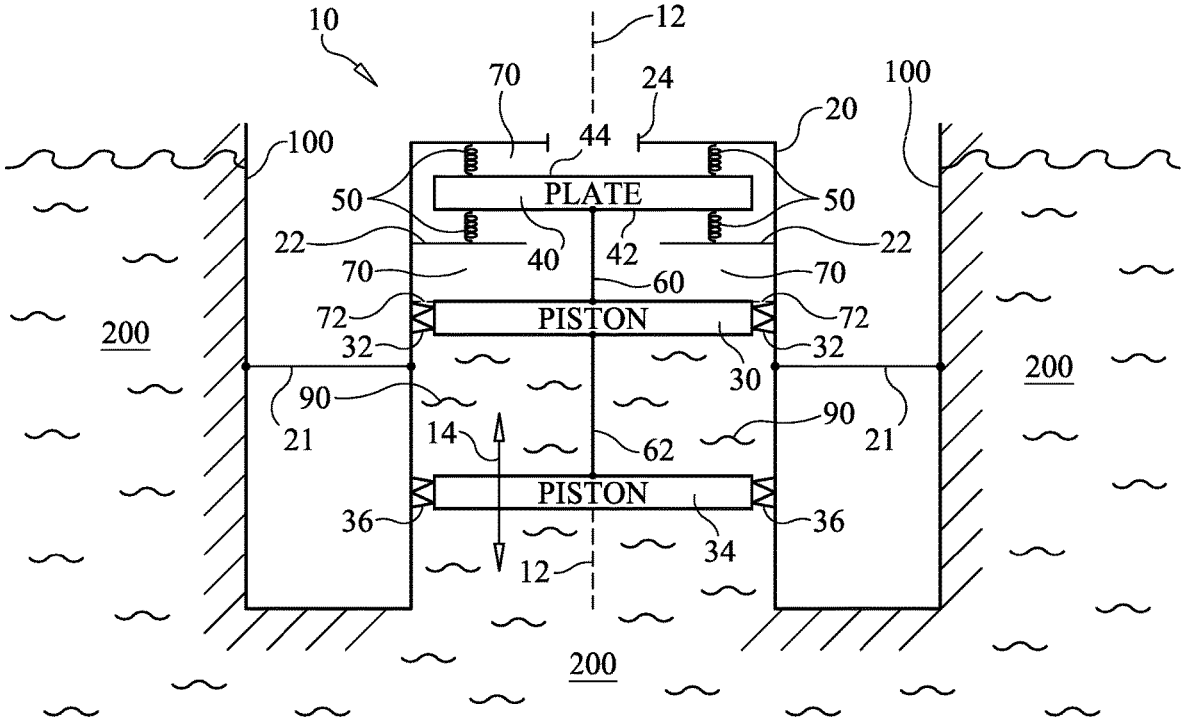
FIG. 5 is a schematic view of a motion damper having two spaced-apart pistons and a liquid filling the volume between the two pistons in accordance with another embodiment of the present invention.

The motion damper embodiment illustrated in FIG. 5 includes a second piston 34 sealed within housing 20 and fixedly coupled to piston 30 in a spaced-apart relationship. Pistons 30 and 34 are coupled to one another for movement in correspondence with one another along axis of damping sensitivity 12. For example, one or more supports 62 can be used to fixedly couple piston 30 to piston 34. Similar to piston 30, piston 34 is sealed within housing 20 by, for example, an annular rolling diaphragm 36 that permits one-dimensional movement of piston 34 along axis of damping sensitivity. Piston 30 is disposed between piston 34 and plate 40. In this embodiment, liquid 90 fills the sealed volume between pistons 30 and 34. That is, the mass of liquid 90 is a fixed mass captured in the sealed volume between pistons 30 and 34 in housing 20. The face of piston 30 facing towards plate 40 is commensurate with the above-described line of delineation 72 of air chamber 70. The face of piston 34 facing away from piston 30 is exposed, for example, to the external body of water 200. When water 200 moves to apply pressure to piston 34 or moves to pull away from piston 34, motion of structure 100 is damped in the same way as described above for FIG. 3. In some embodiments of the present invention, this two-piston arrangement can be configured such that piston 34 is not in contact with body of water 200 as is shown above in FIGS. 1 and 2.

As mentioned above, the motion damper of the present invention can be used in isolation or in multiples thereof. In some embodiments of the present invention, multiple independently-operating motion dampers can be distributed about a floating structure. In some embodiments of the present invention, multiple motion dampers can be coupled together to work cooperatively to damp motion caused by wave action as the wave propagates along or across a floating structure. Three floating structures configured with multiple motion dampers will now be described with reference to FIGS. 6-8. In each embodiment, a floating structure 100 has a centerline (e.g., bow-to-stem centerline, port-to-starboard centerline, etc.) indicated by a dashed line 102. Each embodiment shown in FIGS. 6-8 has a motion damper 10 coupled to floating structure 100 on each of opposing sides of centerline 102.

Figure 6:
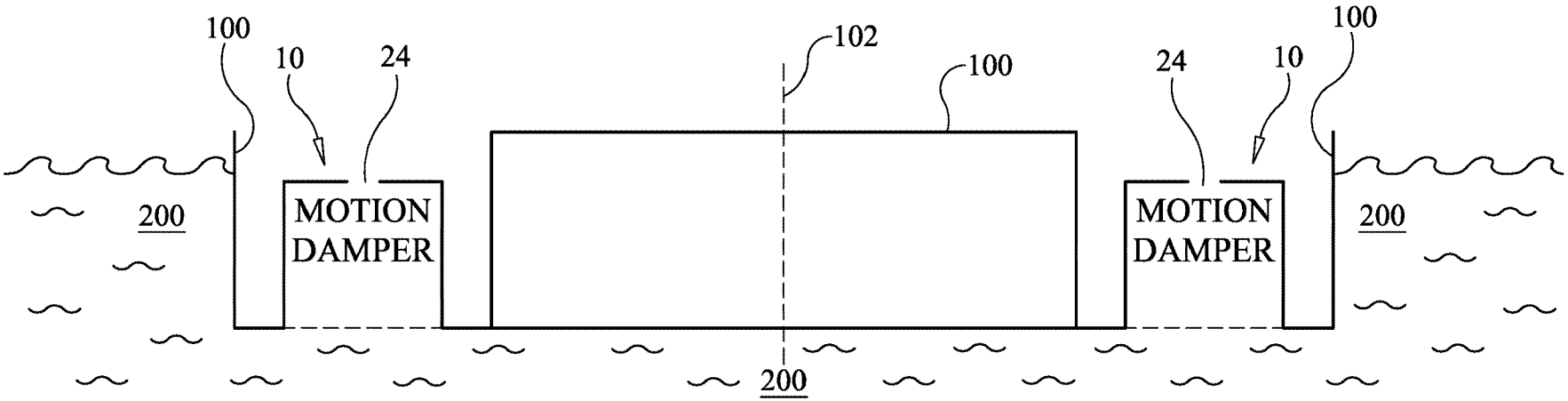
FIG. 6 is a schematic view of a floating structure having two independently-operating motion dampers of the present invention installed thereon in accordance with an embodiment of the present invention.

In the FIG. 6 embodiment, each motion damper 10 has its piston (e.g., the above-described piston 30 or 34 but not shown for clarity of illustration) exposed to water 200 and has its vent 24 open to the ambient atmosphere. As described above, vent 24 can be configured for controlling/damping the movement of air there through. In the FIG. 7 embodiment, each motion damper 10 has its piston (e.g., the above-described piston 30 or 34 but not shown for clarity of illustration) exposed to water 200. However, the vents 24 of the two motion dampers 10 are placed in fluid communication with one another by a manifold 26 that can incorporate one or more air damper devices (not shown) therein to control the flow of air between the air chambers of motion dampers 10. By coupling the air chambers of the two motion dampers 10, the captured fluid masses in motion dampers 10 are cross-coupled such that motion dampers 10 cooperate to act as a sway bar to damp out wave propagation-induced motion of floating structure 100. In the FIG. 8 embodiment, motion dampers 10 are also coupled to one another by a manifold 28 such that the faces of the dampers' liquid-mass-capturing pistons (e.g., piston 30 or piston 34) are in fluid communication with one another as opposed to being exposed to water 200. Manifold 28 can be pressurized with the pressurization thereof being used as an additional and controllable spring force for the captured liquid mass within each motion damper 10. In some embodiments of the present invention, manifold 28 can be vented to the atmosphere.

The advantages of the present invention are numerous. The motion damper is passive and self-contained thereby eliminating the need for control systems for many applications while also simplifying maintenance. The present invention lends itself to a modular design such that the whole unit can be removed and replaced if needed. The response frequency of the motion damper is not dependent upon the geometry of the liquid-mass-containment housing. Because the response frequency is independent of the motion damper's geometry, a single design could be used for a multitude of structures and would not have to be completely redesigned for each one. The compressible portion of the motion damper is separate from its piston to provide for control over the motion damper's response frequency. The vent/damping element is also separate from the piston to provide for control over the damping properties. Multiple motion dampers can be cross-coupled to potentially increase the effectiveness of motion damping. For multiple motion damper embodiments utilizing coupling manifolds that may be pressurized, an air pressurization system can be included to provide for tuning of the response of the cooperatively-coupled motion dampers. The present invention is particularly valuable for maritime applications where mitigations of heave, pitch, and roll is needed. However, it is to be understood that the present invention can be adapted for use in any structure to mitigate unwanted dynamics.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A motion damper for floating structures, comprising:

a housing adapted to be coupled to a floating structure wherein said housing moves in correspondence with the floating structure, said housing including a wall with a vent, said housing having an air chamber therein in fluid communication with said vent;

a piston sealed within said housing for one-dimensional motion therein;

a rigid plate disposed within said housing in said air chamber, said rigid plate disposed between said piston and said vent;

said rigid plate being spaced apart from and fixedly coupled to said piston, wherein said rigid plate moves in correspondence with said one-dimensional motion of said piston; and at least one spring mounted in said housing and coupled to said rigid plate for applying a force to said rigid plate in opposition to said one-dimensional motion of said piston.

2. A motion damper as in claim 1, further comprising a liquid disposed within said housing and in contact with said piston.

3. A motion damper as in claim 2, wherein said liquid comprises water.

4. A motion damper as in claim 2, wherein said liquid is separated from said air chamber by said piston.

5. A motion damper as in claim 2, wherein said liquid is disposed between said piston and said rigid plate, said liquid having a free surface in said housing, said free surface abutting said air chamber.

6. A motion damper as in claim 2, further comprising a second piston wherein said piston is disposed between said rigid plate and said second piston, said second piston sealed within said housing, said second piston fixedly coupled to said piston wherein said second piston moves in correspondence with said one-dimensional movement of said piston, said liquid being disposed between said piston and said second piston.

7. A motion damper as in claim 1, wherein said at least one spring comprises a plurality of springs disposed about and coupled to opposing faces of said rigid plate.

8. A motion damper as in claim 1, further comprising an air damper device coupled to said vent.

9. A motion damper for floating structures, comprising:

a housing adapted to be coupled to a structure floating on water wherein said housing moves in correspondence with the structure, said housing including a wall with a vent, said housing having an air chamber therein in fluid communication with said vent;

a piston sealed within said housing for one-dimensional motion therein;

a rigid plate disposed within said housing in said air chamber, said rigid plate disposed between said piston and said vent;

at least one support for coupling said rigid plate to said piston in a spaced-apart fashion, wherein said rigid plate moves in correspondence with said one-dimensional motion of said piston; and springs mounted in said housing and coupled to opposing faces of said rigid plate for applying forces to said rigid plate in opposition to said one-dimensional motion of said piston.

10. A motion damper as in claim 9, further comprising a liquid disposed within said housing and in contact with said piston.

11. A motion damper as in claim 10, wherein said liquid comprises water.

12. A motion damper as in claim 10, wherein said liquid is separated from said air chamber by said piston.

13. A motion damper as in claim 10, wherein said liquid is disposed between said piston and said rigid plate, said liquid having a free surface in said housing, said free surface abutting said air chamber.

14. A motion damper as in claim 10, further comprising a second piston wherein said piston is disposed between said rigid plate and said second piston, said second piston sealed within said housing, said second piston fixedly coupled to said piston wherein said second piston moves in correspondence with said one-dimensional movement of said piston, said liquid being disposed between said piston and said second piston.

15. A motion damper as in claim 8, further comprising an air damper device coupled to said vent.

16. A motion damper for floating structures, comprising:

at least one housing;

each said housing adapted to be coupled to a portion of a structure floating on a body of water wherein said housing moves in correspondence with the portion of the structure as the body of water acts on the structure;

each said housing including a wall with a vent, an air chamber in said housing and in fluid communication with said vent, a piston sealed within said housing for one-dimensional motion therein, a rigid plate disposed within said housing in said air chamber, said rigid plate disposed between said piston and said vent, said rigid plate being spaced apart from and fixedly coupled to said piston, wherein said rigid plate moves in correspondence with said one-dimensional motion of said piston, at least one spring mounted in said housing and coupled to said rigid plate for applying a force to said rigid plate in opposition to said one-dimensional motion of said piston, and a liquid disposed within said housing and in contact with said piston.

17. A motion damper as in claim 16, wherein said liquid comprises water.

18. A motion damper as in claim 16, wherein said liquid comprises water from the body of water.

19. A motion damper as in claim 16, wherein said liquid is separated from said air chamber by said piston.

20. A motion damper as in claim 16, wherein said liquid is disposed between said piston and said rigid plate, said liquid having a free surface in said housing, said free surface abutting said air chamber.

21. A motion damper as in claim 16, further comprising a second piston wherein said piston is disposed between said rigid plate and said second piston, said second piston sealed within said housing, said second piston fixedly coupled to said piston wherein said second piston moves in correspondence with said one-dimensional movement of said piston, said liquid being disposed between said piston and said second piston.

22. A motion damper as in claim 16, wherein said at least one spring comprises a plurality of springs disposed about and coupled to opposing faces of said rigid plate.

23. A motion damper as in claim 16, further comprising an air damper device coupled to said vent.

* * * * *